US007824313B2

(12) United States Patent
Giannelli et al.

(10) Patent No.: US 7,824,313 B2
(45) **Date of Patent: *Nov. 2, 2010**

(54) EXERCISE DEVICE FOR CROSS TRAINING

(75) Inventors: Raymond Giannelli, Franklin, MA (US); Scott Lee, Pomfret, CT (US)

(73) Assignee: Cybex International, Inc., Medway, MA (US)

( * ) Notice: Subject to any disclaimer, the term of this patent is extended or adjusted under 35 U.S.C. 154(b) by 115 days.

This patent is subject to a terminal disclaimer.

(21) Appl. No.: 11/671,028

(22) Filed: Feb. 5, 2007

(65) Prior Publication Data

US 2007/0129217 A1 Jun. 7, 2007

Related U.S. Application Data

(63) Continuation of application No. 10/294,017, filed on Nov. 13, 2002, now abandoned.

(60) Provisional application No. 60/337,498, filed on Nov. 13, 2001.

(51) Int. Cl.
*A63B 22/00* (2006.01)

(52) U.S. Cl. ..... 482/52; 482/51

(58) Field of Classification Search ..... 482/51–53, 482/56, 57, 70, 71, 79, 80; 601/23, 27, 34; 434/254, 255

See application file for complete search history.

(56) References Cited

U.S. PATENT DOCUMENTS

| | | | | |
|---|---|---|---|---|
| 326,247 A | | 9/1885 | Root | |
| 1,990,124 A | * | 2/1935 | Kabisius | 482/56 |
| 2,019,224 A | * | 10/1935 | Hess | 482/56 |
| 2,109,775 A | * | 3/1938 | Hudson | 482/56 |
| 3,756,595 A | | 9/1973 | Hague | |
| 3,791,646 A | * | 2/1974 | Marchignoni | 482/56 |
| 4,861,023 A | | 8/1989 | Wedman | |
| 5,004,224 A | | 4/1991 | Wang | |
| 5,039,088 A | | 8/1991 | Shifferaw | |

(Continued)

FOREIGN PATENT DOCUMENTS

CA 2 407 758 A1 11/2004

(Continued)

OTHER PUBLICATIONS

Dr. Theodor Büdingen in Konstanz "Bewegungsapparat für Bettlägerige, insbesondere Herzkranke" Oct. 20, 1908.

(Continued)

*Primary Examiner*—Loan Thanh
*Assistant Examiner*—Tam Nguyen
(74) *Attorney, Agent, or Firm*—Rissman Hendricks & Oliverio, LLP

(57) ABSTRACT

An exercise device includes one or more foot supports movable along an arcuate path defined around a point of rotation. The arcuate path is divisible into machine defined user selectable arc segments and the movement of the foot support(s) is limited to the machine defined user selected arc segment. The exercise device can include a frame, a linkage movably engaged with the frame, a foot support movably engaged with the linkage, a crank arm movably engaged with the frame, a motor operative to move the crank arm location with respect to the frame, and a drive linkage movably engaging the linkage.

2 Claims, 6 Drawing Sheets

U.S. PATENT DOCUMENTS

| | | | | |
|---|---|---|---|---|
| 5,242,343 | A | | 9/1993 | Miller |
| 5,279,529 | A | | 1/1994 | Eschenbach |
| 5,383,829 | A | | 1/1995 | Miller |
| 5,391,130 | A | | 2/1995 | Green |
| 5,496,235 | A | | 3/1996 | Stevens |
| 5,562,574 | A | | 10/1996 | Miller |
| 5,584,781 | A | | 12/1996 | Chen |
| 5,605,521 | A | | 2/1997 | Hsieh |
| 5,643,153 | A | | 7/1997 | Nylen et al. |
| 5,655,998 | A | | 8/1997 | Yu |
| 5,681,244 | A | | 10/1997 | Hsieh et al. |
| 5,685,804 | A | | 11/1997 | Whan-Tong et al. |
| 5,707,320 | A | * | 1/1998 | Yu ..... 482/56 |
| 5,720,698 | A | | 2/1998 | Dalebout et al. |
| 5,788,610 | A | | 8/1998 | Eschenbach |
| 5,792,027 | A | | 8/1998 | Gvoich |
| 5,833,584 | A | | 11/1998 | Piaget et al. |
| 5,857,940 | A | | 1/1999 | Husted |
| 5,876,307 | A | | 3/1999 | Stearns et al. |
| 5,879,271 | A | | 3/1999 | Stearns et al. |
| 5,895,339 | A | | 4/1999 | Maresh |
| 5,897,459 | A | * | 4/1999 | Habing et al. ..... 482/53 |
| 5,910,072 | A | | 6/1999 | Rawls et al. |
| 5,913,751 | A | | 6/1999 | Eschenbach |
| 5,916,064 | A | | 6/1999 | Eschenbach |
| 5,921,894 | A | | 7/1999 | Eschenbach |
| 5,957,814 | A | | 9/1999 | Eschenbach |
| 5,993,359 | A | | 11/1999 | Eschenbach |
| 6,004,244 | A | | 12/1999 | Simonson |
| 6,022,296 | A | | 2/2000 | Yu |
| 6,024,676 | A | | 2/2000 | Eschenbach |
| 6,027,430 | A | | 2/2000 | Stearns et al. |
| 6,036,622 | A | | 3/2000 | Gordon |
| 6,042,512 | A | | 3/2000 | Eschenbach |
| 6,045,488 | A | | 4/2000 | Eschenbach |
| 6,053,847 | A | | 4/2000 | Stearns et al. |
| 6,077,196 | A | | 6/2000 | Eschenbach |
| 6,077,198 | A | | 6/2000 | Eschenbach |
| 6,090,013 | A | | 7/2000 | Eschenbach |
| 6,090,014 | A | | 7/2000 | Eschenbach |
| 6,126,573 | A | | 10/2000 | Eschenbach |
| 6,135,926 | A | | 10/2000 | Lee |
| 6,142,915 | A | | 11/2000 | Eschenbach |
| 6,168,552 | B1 | | 1/2001 | Eschenbach |
| 6,210,305 | B1 | | 4/2001 | Eschenbach |
| 6,217,485 | B1 | | 4/2001 | Maresh |
| 6,248,044 | B1 | | 6/2001 | Stearns et al. |
| 6,277,054 | B1 | | 8/2001 | Kuo |
| D450,101 | S | | 11/2001 | Hsu |
| 6,361,476 | B1 | | 3/2002 | Eschenbach |
| 6,551,218 | B2 | | 4/2003 | Goh |
| 6,648,801 | B2 | | 11/2003 | Stearns et al. |
| 6,761,665 | B2 | | 7/2004 | Nguyen |
| 2003/0092532 | A1 | | 5/2003 | Giannelli et al. |
| 2004/0224825 | A1 | | 11/2004 | Giannelli et al. |

FOREIGN PATENT DOCUMENTS

| | | | |
|---|---|---|---|
| CH | 673092 | A5 | 2/1990 |
| DE | 229712 | | 10/1923 |
| FR | 498.150 | | 12/1919 |
| FR | 498150 | | 12/1919 |
| WO | WO 95/00209 | | 1/1995 |
| WO | WO 96/08292 | | 3/1996 |

OTHER PUBLICATIONS

M. Pierre-Joseph Amieux, rèsident en France (Hautes-Alpes) "Appareil mècanothèrapique destine á la mobilisation passive des membres infèrieurs des blessès ou malades alitès" Jun. 6, 1916.

* cited by examiner

EXERCISE DEVICE FOR CROSS TRAINING

CROSS REFERENCE TO RELATED APPLICATIONS

This application claims the benefit of priority to and is a continuation of U.S. patent application Ser. No. 10/294,017 filed Nov. 13, 2002; which in turn claims priority to Provisional Patent Application Ser. No. 60/337,498, filed Nov. 13, 2001, the disclosures of which are incorporated herein by reference in their entirety.

STATEMENT REGARDING FEDERALLY SPONSORED RESEARCH

Not Applicable.

FIELD OF THE INVENTION

This invention relates to exercise equipment, and more particularly to an improved exercise apparatus.

BACKGROUND OF THE INVENTION

Exercise devices that simulate climbing stairs ("stair climbers") have become very popular. Not only are they relatively easy to learn how to use, but also they can, when used properly, provide an excellent cardiovascular workout. Stair climbers, however, have drawbacks in that users can easily "cheat" by leaning or supporting their body weight on an upright portion of the device and by taking short steps. Frequently the users who cheat the most are de-conditioned athletes for whom the device can be the most beneficial. In addition to providing sub-optimal benefits, improper body positioning during exercise can lead to overuse injuries. Another disadvantage of stair climbers is the exercise under normal conditions is fairly demanding. In other words the lowest level of energy expenditure is fairly high. This demands that the user be in fairly good physical condition in order to be able to perform this type of exercise.

One type of exercise device, which seeks to obtain the benefits of stair climbers using a different motion path, is the "cross trainer." A popular type of cross trainer is the "elliptical" trainer. Examples of the elliptical trainer are set forth in U.S. Pat. Nos. 5,685,804; 5,788,610; and 5,242,343. Many of the more popular devices provide footpads supported on an elongate member that is secured at one end to a flywheel and slidable at the other end. Although these devices can provide a relatively smooth motion, the motion path caused by their configuration can be undesirable for several reasons. Specifically, as the footpad moves back and forth, it is also forced to move through a somewhat significant angular change as well. This forces the ankle to move through dorsa flexion and plantar flexion during the transilitory motion. This motion which appears to be similar to the same motion the foot might move through during normal walking gait, is in fact very different and applies significantly different loading to the body. Many consider this pattern of motion and change in loading to feel unnatural and somewhat stressful at higher loads. It is for this reason that many users of cross trainers use them only at very low load settings. Treadmills, it would appear, offer the best range of intensity of exercise with a fairly natural motion. The problem is that in order to get higher rates of energy expenditure on a treadmill, the user must run. Although running is an excellent form of exercise, it has also been well documented that the impact of running applies significant increases in stress to the body.

SUMMARY OF THE INVENTION

The present invention provides a device that creates a motion path that combines the advantageous features of a treadmill, a cross trainer, and a stair climber, is easy to use and has a very natural motion that feels comfortable to use over a wide load range. This increases the overall versatility of the product by offering a smooth low stress exercise for the de-conditioned user, but also challenges the highly conditioned athlete.

In an exemplary embodiment, an exercise device includes one or more foot supports movable along an arcuate path defined around a point of rotation. The arcuate path is divisible into a plurality of machine defined, user selectable arc segments and the movement of the foot support(s) is limited to the machine defined, user selected arc segment.

The exercise device can include a frame having a front region and a rear region and a reciprocal motion assembly secured to the frame. The reciprocal motion assembly includes a first and second pair of linkages engaged with the frame, a portion of each pair of frame linkages being movable back and forth toward the front region and the rear region of the frame. Also included is a first and a second foot support wherein the first foot support is engaged with the first pair of frame linkages and the second foot support is engaged with the second pair of frame linkages such that each foot support is movable, along with its corresponding frame linkage, toward the front and rear regions of the frame. The resistance assembly also includes a first crank arm is engaged with the frame. A second crank arm is also engaged with the frame and is approximately 180 degrees out of phase with the first crank arm. A first drive linkage engages one of the linkages in the first pair of frame linkages and also engages the first crank arm. A second drive linkage engages one of the linkages in the second pair of frame linkages and also engages the second crank arm. In this fashion, the drive linkages are movable in a reciprocal manner toward the front and rear regions of the frame as defined by the rotation of the crank arms causing the first drive linkage and the second drive linkage to move in a bilateral reciprocal manner.

In another embodiment, the exercise device comprises a frame having upper supports, opposing pairs of frame linkages pivotally engaged with opposing upper supports of the frame and a pair of foot supports associated with each pair of frame linkages and pivotally engaged therewith. A crank arm can be movably engaged with the frame and a motor can be provided to operatively move the crank arm location with respect to the frame. A drive linkage movably engages the frame linkages.

BRIEF DESCRIPTION OF THE DRAWINGS

A more complete understanding of the present invention, and the attendant advantages and features thereof will be more readily understood by reference to the following detailed description when considered in conjunction with the accompanying drawings wherein.

DETAILED DESCRIPTION OF THE INVENTION

Generally, the present invention is an exercise apparatus that provides a low impact workout yet offers the potential for an intensive cardiovascular workout by eliminating the unnatural motion and awkward foot alignments typical of many stair-climbing and elliptical training devices. The invention provides one or more foot supports movable along an arcuate path and defined around a point of rotation. The arcuate path is divisible into machine defined, user selectable arc segments. The exercise apparatus includes a frame, a frame linkage movably engaged with the frame, one or more foot supports movably engaged with the frame linkage, a crank movably engaged with the frame, a motor operative to move the crank location with respect to the frame, and a drive linkage movably engaging the frame linkage.

Figure 1:
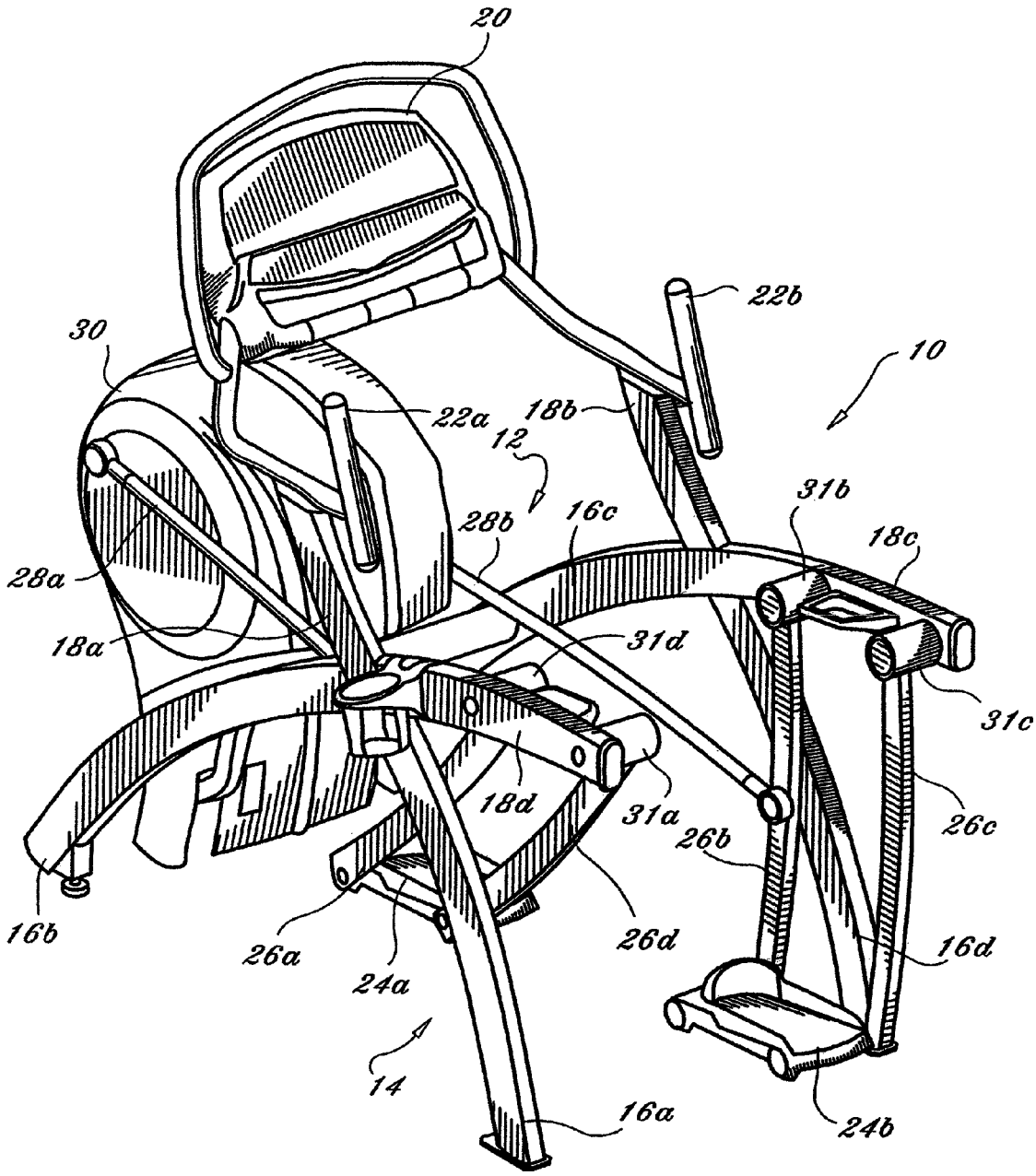
FIG. 1 is a rear perspective view of a device in accordance with the invention.

FIG. 1 is a perspective view of an exercise device in accordance with the present invention. The device includes a frame 10 having a front region 12, a rear region 14, "legs" 16*a*, 16*b*, 16*c* and 16*d*, and upper supports 18*a*, 18*b*, 18*c*, and 18*d*. Upper supports 18*c* and 18*d* comprise part of the arcuate portion of the frame, terminate in legs 16*c* and 16*b* respectively and are an integral part of frame 10. A display/control panel 20 and hand grips 22*a* and 22*b* are secured to the upper supports 18*a* and 18*b*.

Foot supports 24*a* and 24*b* are sized to receive the foot of a user. Foot supports 24*a* and 24*b* are movably connected to, and supported by, forward linkages 26*a* and 26*b*, and rear linkages 26*c* and 26*d*. Linkages 26*a*-26*d* are movably connected to the rear region 14 of frame 10 by upper supports 18*d* and 18*c*. Although the device is shown with opposing pairs of linkages supporting each foot support, other embodiments are contemplated having fewer or more linkages supporting and controlling the range and path of motion of foot supports 24*a* and 24*b* associated with the linkage(s).

The foot supports 24*a* and 24*b* approximate a shod human foot in size and shape. They can include a non-skid surface and be bounded by one or more low lips to help a shoe remain in place on the foot supports during use. Alternately, straps may maintain each foot within the foot support to further retain the user's foot in place during use. However, as used herein, a "foot support" can also encompass any designated support such as a pedal, a pad, a toe clip, or other foot/toe/leg and device interface structure as is known in the art.

The forward linkages 26*a* and 26*b* are movably connected to drive linkages 28*a* and 28*b*; and the drive linkages are in turn connected to other elements (illustrated in FIGS. 3 and 4 and described below) concealed by a housing 30. In other embodiments, the drive linkages 28*a* and 28*b* are connected directly to the foot supports 24*a* and 24*b*. Additionally, "foot supports" can be on or integral to either the forward linkages or to the one or more linkages joined to the frame.

As illustrated in FIG. 1, representative movable connectors 31*a*, 31*b*, 31*c*, and 31*d* include pivot assemblies, as known in the art, that provide very smooth and easy relative rotation or reciprocal motion by elements joined by the pivot assemblies. Movable connectors 31*b* and 31*d* rotatably couple forward linkages 26*b* and 26*a*, respectively, to upper supports 18*c* and 18*d*. Movable connectors 31*c* and 31*a* rotatably couple rear linkages 26*c* and 26*d*, respectively, to upper supports 18*c* and 18*d*. Other connection assemblies that permit similar motion are contemplated by the invention. The movable connectors allow for a smooth and controlled swinging of foot supports 24*a* and 24*b* in an arcuate path.

Figure 2:
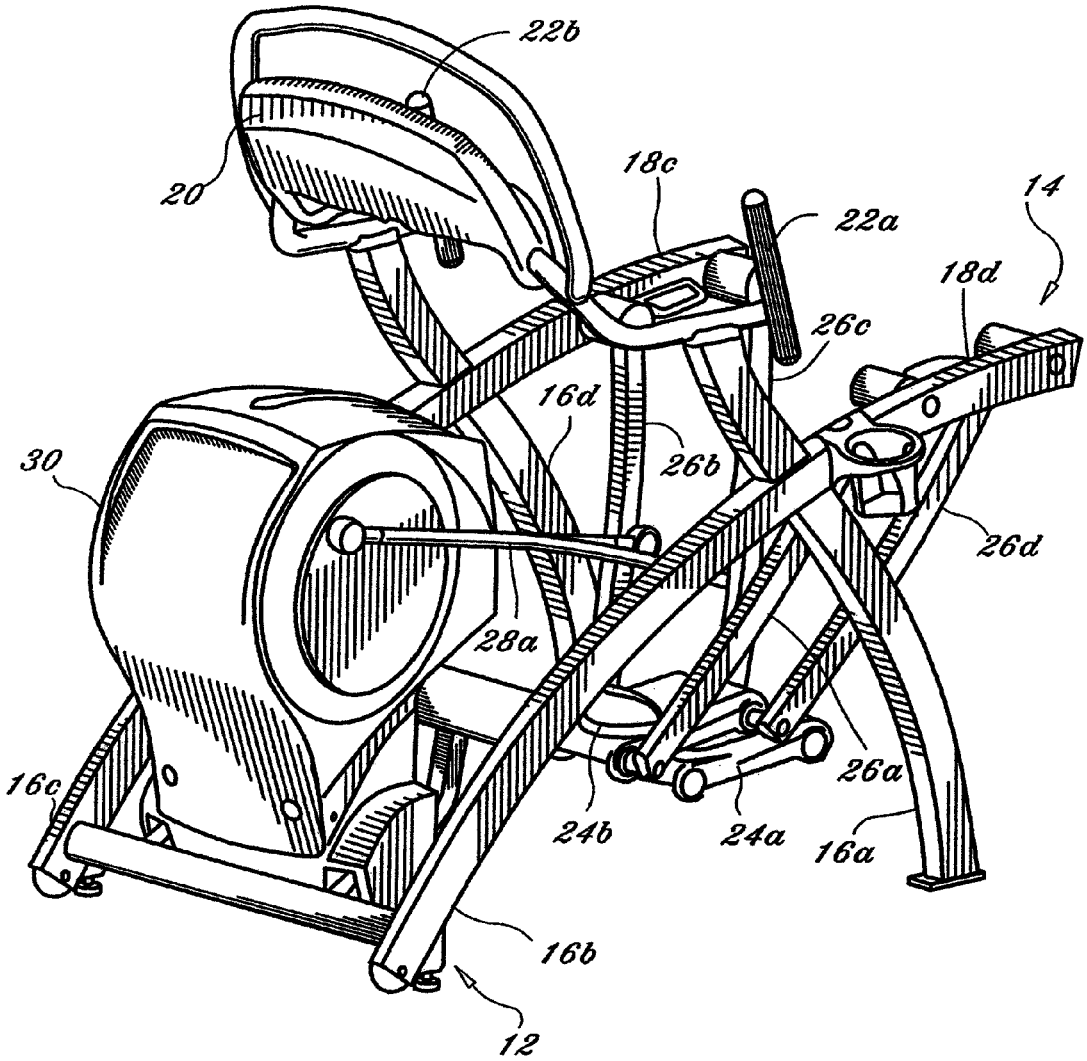
FIG. 2 is a front perspective view of the device of FIG. 1.

FIG. 2 is a front perspective view of the device shown in FIG. 1 illustrating the elements described above from a different angle. This illustration shows the device from the front region 12 perspective. Once again it can be seen that foot supports 24*a* and 24*b* are suspended from their respective linkages. Drive linkages 28*a* and 28*b* (not shown in FIG. 2) are coupled at their first ends to the substantial mid-point of front linkages 26*a* and 26*b*, respectively. Drive linkages 28*a* and 28*b* are coupled at their second ends to a crank assembly (not shown) contained within housing 30, which contains the resistance assembly shown in FIG. 4 and described in greater detail below.

Figure 3:
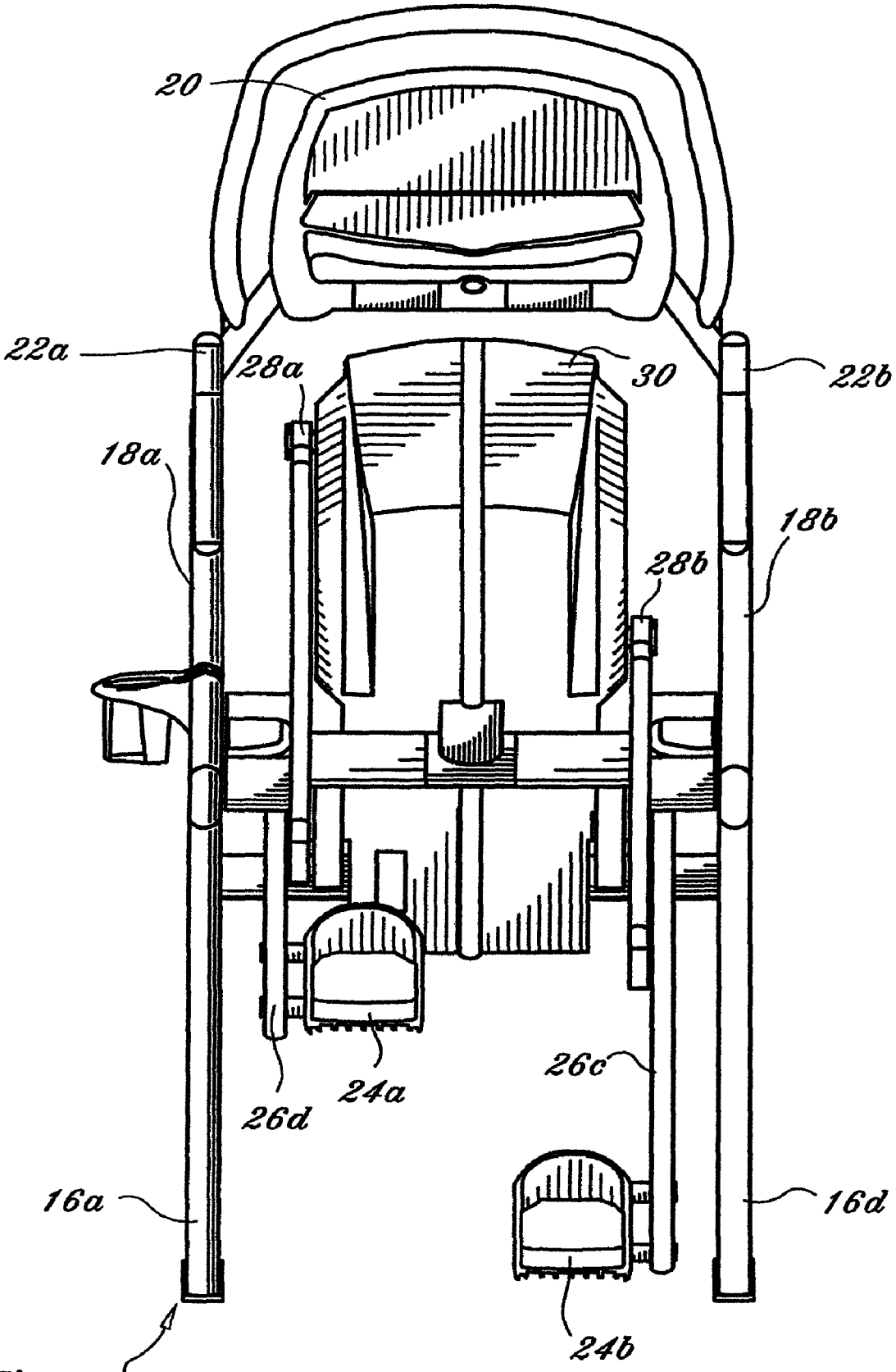
FIG. 3 is a rear view of the device of FIG. 1.

FIG. 3 is a rear view of the device of FIG. 1. The illustration in FIG. 3 is how a user would view the device upon mounting. Foot supports 24*a* and 24*b* are positioned to allow the user to place his or her feet on the pedals. As described above, clips or straps may be used to firmly secure the user's feet within their respective foot supports. Drive linkages 28*a* and 28*b* are coupled to either side of housing 30. Crankshaft 32 (shown in FIG. 4) projects from each side of housing 30 and is connected to each of the drive linkages via crank arms 40*a* and 40*b*. Handles 22*a* and 22*b* allow the user to steady themselves while the user's legs move in an arcuate path of motion.

Monitor 20 may include displays and controls to allow the user to manipulate the intensity of the resistance to create an easier or more difficult exercise routine and to adjust the motion path of the foot supports to one that is more inclined or less inclined.

Figure 4:
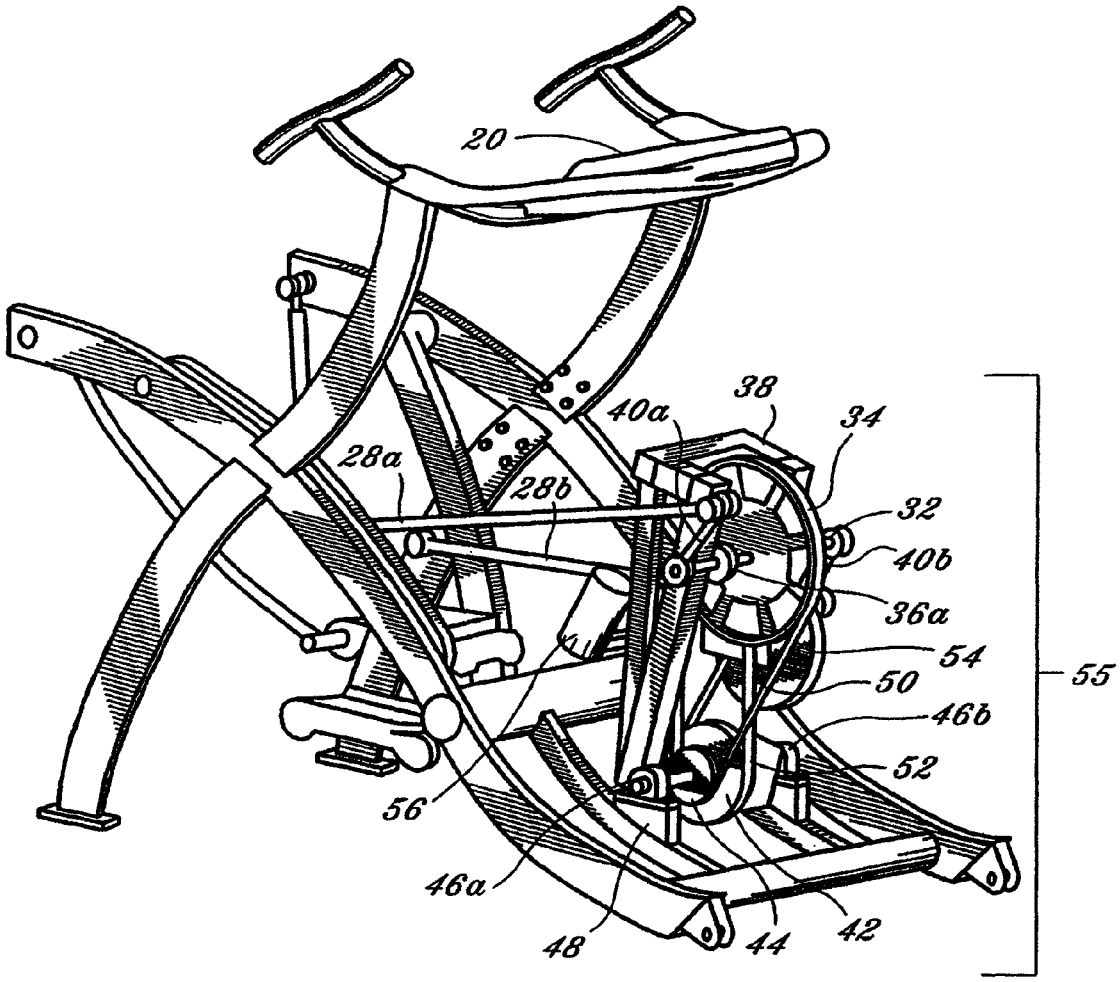
FIG. 4 is a front perspective view of the device of FIG. 1, shown with a housing for moving parts removed.

In FIG. 4, where an alternate embodiment of the present invention is shown, housing 30 is not shown so that additional internal elements of resistance assembly 55 therein can be revealed. For example, the forward ends of drive linkages 28*a* and 28*b* are shown attached to crank arms 40*a* and 40*b*, which are connected to a crankshaft 32 that turns a pulley 34 in communication with other elements described below.

FIG. 4 illustrates the pulley 34 mounted on the crankshaft 32. Top bearings 36*a* and 36*b* receiving the crankshaft 32 are secured to a mounting 38. Crank arms 40*a* and 40*b* are secured to each end of the crankshaft 32 and are movably coupled to the drive linkages 28*a* and 28*b*, respectively, as is known in the art. A second pulley 42, rotatably mounted on stationary shaft 44, which is mounted to frame member 38, is coupled to the pulley 34 with a belt 50. A second belt 52 couples the second pulley 42 to a brake/flywheel assembly 54, which includes a rotatable mass such as a flywheel secured to the mounting 38.

As shown in FIG. 4, the mounting 38 pivots around bottom bearings 46*a* and 46*b* so as to be rotatable fore and aft. A motor 56 or supplemental motor (not shown), responsive to input from the display/control panel 20, acts as a tilt actuator to tilt the mounting 38 and the elements affixed thereto. As shown, the pulley 34, the second pulley 42 and the resistance assembly 55 including a flywheel rotate about an axis that is orthogonal to the longitudinal axis of the frame 10. It should be clear from the above description of the drive system that both pedals 24*a* and 24*b* are synchronized together by the motion of crankshaft 32. It should also be noted that there are no clutches between crankshaft 32 and brake/flywheel assembly 54. This is done to allow the inertia of brake/flywheel assembly 54 within resistance assembly 55 to assist the pedals 24*a* and 24*b* through the weaker portion of the range of motion of the users leg.

Although the brake/flywheel assembly 54 is the preferred component in resistance assembly 55, various other braking devices such as known to those skilled in the art can be associated with the rotatable elements to inhibit rotation thereof. The braking device may include but is not limited to any of the following: friction and air resistance devices such as fans, pneumatic or hydraulic devices, as well as various other types of electromechanical braking devices. This list is by no means exhaustive and represents only a few examples of resistance mechanisms that may be incorporated into the present invention. The configuration disclosed herein, i.e. use of a flywheel, is especially desirable because it promotes a very smooth, bilateral, reciprocal motion that is easily maintained by a device user.

Figure 5:
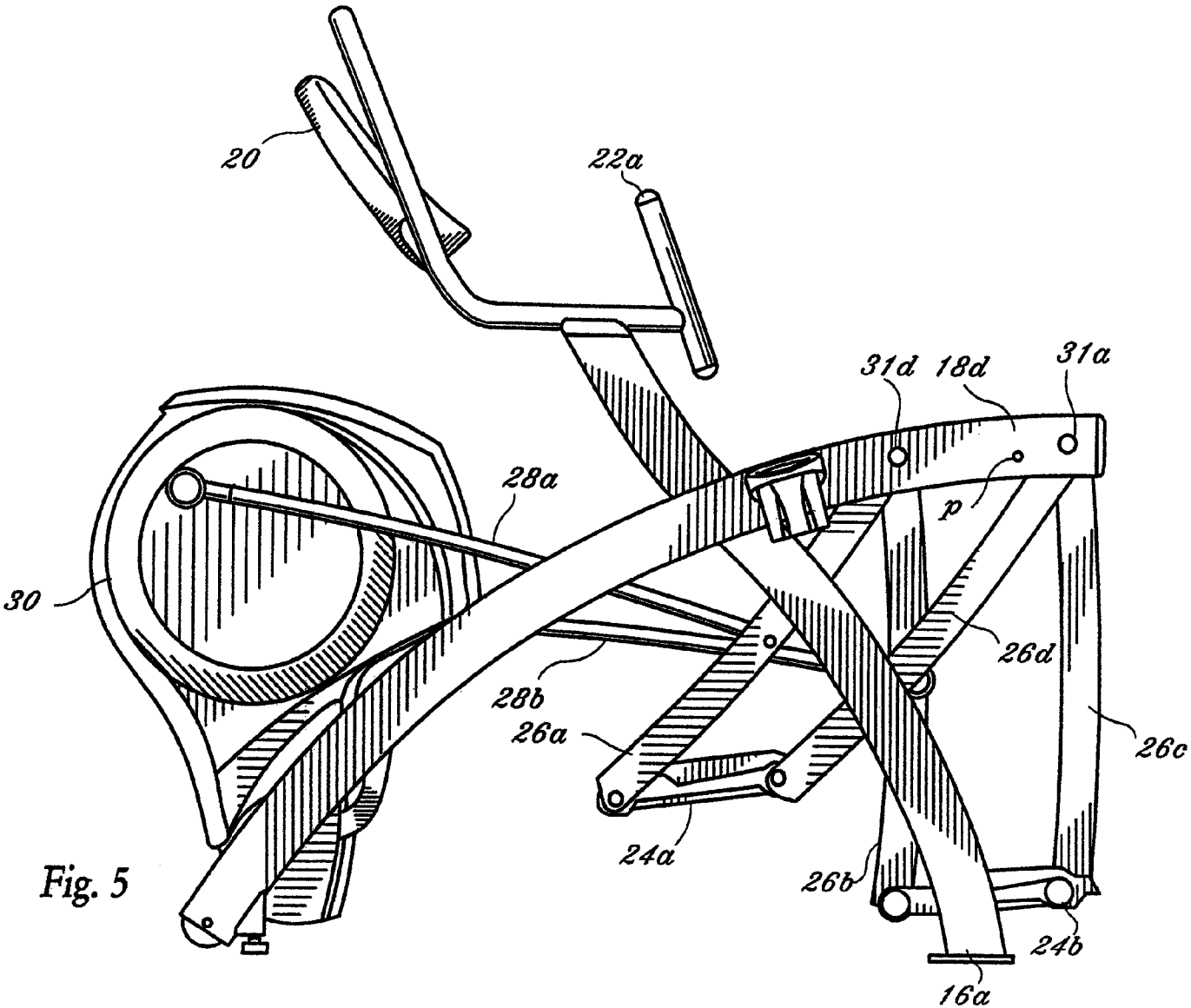
FIG. 5 is a side view of the device of FIG. 1.
Figure 6:
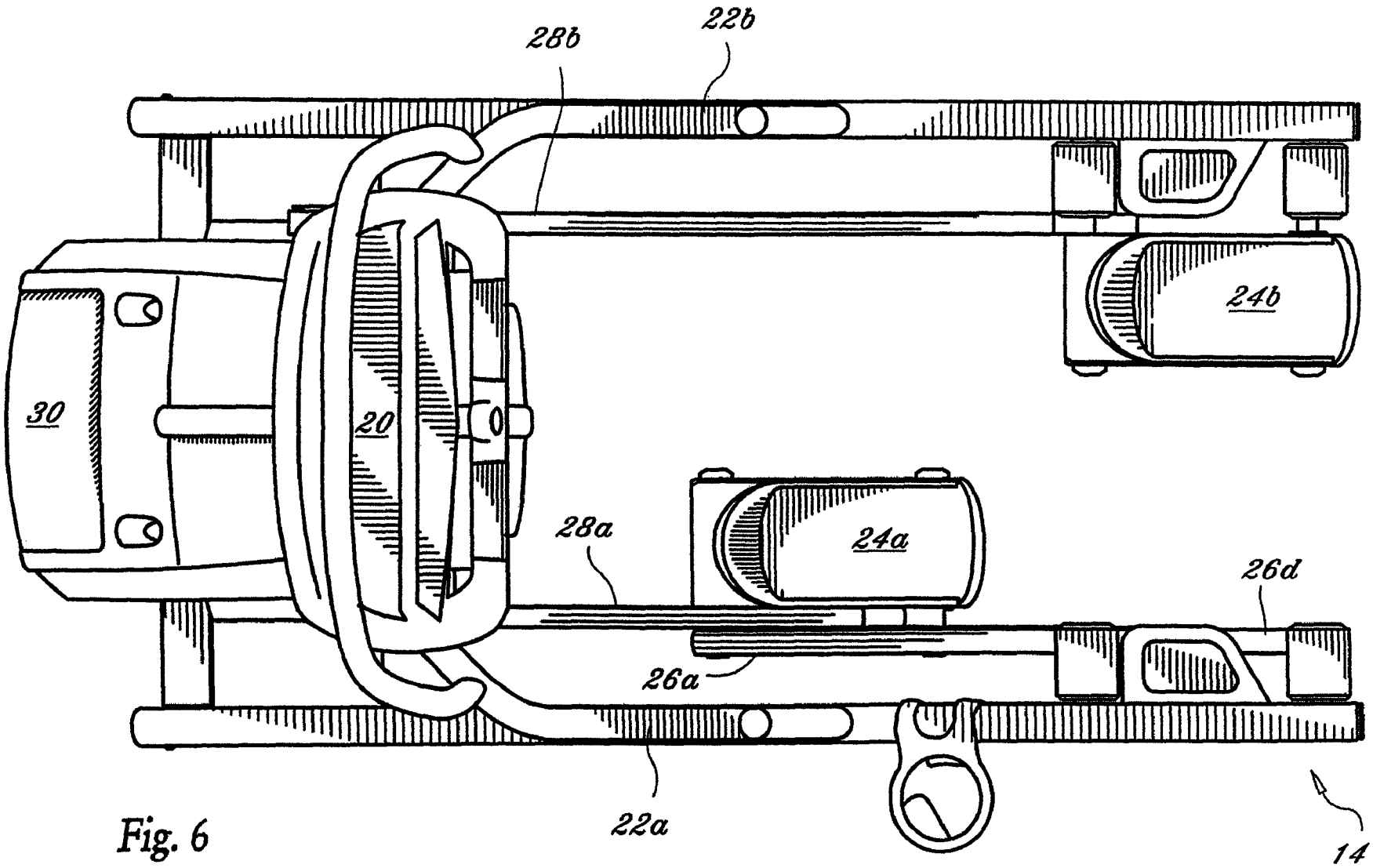
FIG. 6 is a top view of the device in FIG. 1.

FIG. 5 is a side view of the device. In this view, the foot supports 24*a* and 24*b*, forward linkages 26*a*, 26*b* and rear linkages 26*c*, 26*d* are presented from a perspective that allows ready visualization of the path that foot supports 24*a* and 24*b*, and thus a user's feet, will traverse as the foot supports move fore and aft while suspended from the forward and rear linkages. It will be noted that as foot supports 24*a* and 24*b* move fore and aft, the forward and aft limit of motion is not unbounded. Rather, the range of motion is defined by the length of the crank arms 40*a* and 40*b* (shown in FIG. 4), which provide an appropriate stride length. Further, because the foot supports 24*a* and 24*b* are pivotally connected to, and swing with, the forward linkages 26*a*, 26*b* and rear linkages 26*c*, 26*d*, the foot supports travel a curved or arcuate path, and not an elliptical path, to provide more favorable biomechanics.

The motion path for the foot supports 24*a* and 24*b* can also be altered by adjusting the position of mounting 38. As described above, the mounting 38 is pivotally mounted to the frame member 48 and pivots fore and aft upon command. As is evident by reference to the Figures, pivoting the mounting 38 forward moves the components secured directly or indirectly thereto forward. Likewise, pivoting the mounting 38 rearward causes the components secured directly or indirectly thereto to move rearward. This repositioning causes the motion path of the foot supports 24*a* and 24*b* to move to a different location along an arcuate path around a point of rotation "p", shown here between pivot assemblies 31*b* and 31*c*, at a distance established by the length of the forward and rear linkages 26*a*, 26*b*, 26*c* and 26*d*. Thus, the specific location on the arc or arc segment ("the motion path") is user selectable to increase or decrease stride angle and location from a number of user selectable points, or arc segments, defined around the point of rotation.

In operation, a user approaches the device from the rear region 14, grasps the hand grips 22*a* and 22*b*, and places a foot on each of the foot supports 24*a* and 24*b*. The user's feet and legs begin to move fore and aft in a comfortable stride. The user selects an exercise program or manually adjusts the device by imputing commands via the display/control panel 20. In response to the command input, the resistance to fore and aft movement of the foot supports 24*a* and 24*b* can be altered by impeding rotation of the pulleys 34, 42 or the flywheel. Also, in response to command input, the mounting 38 is moved fore or aft. As shown, when the mounting 38 moves forward, the motion path of the foot supports is on a more inclined or vertical defined arc segment. To discontinue use of the device, a user simply stops striding, thereby causing the movement of the device to stop, and dismounts from the foot supports.

It will be appreciated by persons skilled in the art that the present invention is not limited to what has been particularly shown and described herein, and that the drawings are not necessarily to scale. A variety of modifications and variations are possible in light of the above teachings without departing from the scope and spirit of the invention, which is limited only by the following claims.

What is claimed is:

1. Method of performing an exercise by an exerciser having two feet on an exercise machine having a foot support, for each foot of the exerciser, suspended on a frame via a linkage assembly wherein the linkage assembly is interconnected to a resistance mechanism for back and forth resisted movement of each foot support on the frame and the exercise machine defines an arcuate path along which each foot support travels according to a defined interconnection of the linkage assembly to the resistance mechanism wherein the interconnection of the resistance mechanism to the linkage assembly is adjustable to limit travel of each foot support to a selected segment of the arcuate path, the method comprising adjusting the interconnection of the resistance assembly to the linkage assembly to select a first segment of the arcuate path as the path of travel of each foot support prior to the beginning of an exercise cycle; and driving each foot support with a foot of the exerciser back and forth along the selected first segment of the arcuate path during an exercise cycle in opposition to resistance exerted on each foot support by the resistance assembly.

2. The method of claim 1, further comprising adjusting the interconnection of the resistance assembly to the linkage assembly to select a second segment of the arcuate path subsequent to driving one of the foot supports through the first segment and driving each foot support with a foot of the exerciser through the second segment.

* * * * *